US009382679B2

(12) United States Patent
Bevans et al.

(10) Patent No.: US 9,382,679 B2
(45) Date of Patent: Jul. 5, 2016

(54) PORTABLE DEVICE FOR SOLID PET WASTE COLLECTION AND ENVIRONMENTALLY SOUND WASTE DISPOSAL

(71) Applicants: Edward Logan Bevans, Sacaramento, CA (US); Melinda A. Gearhart, Sacramento, CA (US); Henry Patrick Bevans, Jr., Worley, ID (US)

(72) Inventors: Edward Logan Bevans, Sacaramento, CA (US); Melinda A. Gearhart, Sacramento, CA (US); Henry Patrick Bevans, Jr., Worley, ID (US)

( * ) Notice: Subject to any disclaimer, the term of this patent is extended or adjusted under 35 U.S.C. 154(b) by 0 days.

(21) Appl. No.: 14/609,275

(22) Filed: Jan. 29, 2015

(65) Prior Publication Data

US 2015/0233068 A1 Aug. 20, 2015

Related U.S. Application Data

(60) Provisional application No. 61/934,717, filed on Feb. 1, 2014.

(51) Int. Cl.
*A01K 29/00* (2006.01)
*E01H 1/12* (2006.01)

(52) U.S. Cl.
CPC ..... *E01H 1/1206* (2013.01); *E01H 2001/122* (2013.01); *E01H 2001/1286* (2013.01)

(58) Field of Classification Search
CPC ..... E01H 1/1206; E01H 2001/1286; E01H 2001/122; A01B 1/02; A01K 1/0107; A01K 1/0114
USPC ..... 294/1.3, 1.5, 176; D7/691
See application file for complete search history.

(56) References Cited

U.S. PATENT DOCUMENTS 1,283,403 A * 10/1918 Eustis ..... A47K 1/09 206/209.1
3,796,453 A * 3/1974 Grimes ..... E01H 1/1206 15/257.2
4,226,456 A * 10/1980 Barnett ..... E01H 1/1206 15/257.1
5,577,462 A * 11/1996 Korth ..... A01K 1/0114 119/166
5,829,603 A * 11/1998 Martineau ..... A46B 17/06 211/66
5,945,076 A * 8/1999 Leonard ..... A46B 11/0006 134/184
6,039,368 A * 3/2000 Kowalczyk ..... A01K 1/0114 119/161
2014/0183886 A1* 7/2014 Hollett ..... A01K 1/0114 294/1.3

* cited by examiner

*Primary Examiner* — Stephen Vu

(57) ABSTRACT

A portable apparatus of component parts aligned and detachable from one another in such a way as to allow for sanitary and ergonomic collection, hands-free transportation, and environmentally optimal disposal of pet waste. The apparatus comprises a cylindrical container that when assembled with a removable base and removable lid creates an airtight container enhanced with a disposable, flushable liner that fits in the interior of the waste collection container. The top of the lid incorporates a, telescoping handle, while the underside of the lid incorporates a shovel unit that fits inside the container and is offset and aligned in close proximity to the walls of the container to ensure ample room for both the shovel unit and collected pet waste when the removable lid and base are both attached to temporarily seal the container. The apparatus also comprises a removable base cap that when attached to the base of the closed container creates a compartment separate from the collected pet waste. The apparatus is designed for portability with a clip or tether means for attaching it to the user's articles of clothing or mode of transportation.

9 Claims, 6 Drawing Sheets

PORTABLE DEVICE FOR SOLID PET WASTE COLLECTION AND ENVIRONMENTALLY SOUND WASTE DISPOSAL

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING, COMPACT DISC APPENDIX

Not Applicable

BACKGROUND/FIELD OF THE INVENTION

The present invention is in the technical field of pet products. More specifically, the present invention is in the technical field of pet waste collection, temporary storage, and disposal. More specifically, the present invention addresses the need for portable devices to be used by individuals for the sanitary collection, temporary storage, containment, transport, and environmentally sound disposal of pet waste into the sewer system.

The prior art found in a search of U.S. Patents is listed as Appendix A.

The present invention is designed to address the pressing environmental need for more people to clean up after their pets, and for those who do so to practice proper separation of pet waste from trash/landfill and biodegradable composting by facilitating the disposal of pet waste into the sewage system.

As more and more towns, cities, and states across the U.S. and regulators around the world require pet owners to remove and properly dispose of pet waste that would otherwise be deposited in public places, previously available options are also being regulated out of existence. Simultaneously, an increasing number of regulatory bodies have established environmentally sound waste collection practices, in which waste is separated into garbage, various recyclables, and compostable waste. The present invention brings together the goals of these efforts with a device that encourages pet owners to clean up and deposit pet waste where it belongs; not in a plastic bag or in the garbage, and not in the compost in a biodegradable bag, but in a secure receptacle that makes it easy to collect, contain, and transport the pet waste to a healthier, more environmentally sound end: into the toilet and ultimately into sewage treatment facilities.

The present invention is designed to be easily manufactured in different sizes to address the clean-up requirements of small, medium, and large pets, as well as to address the need for larger containers to accommodate the increasingly popular practice of individuals ("pet walkers") walking multiple pets in public places.

The present invention addresses the drawbacks of current methods of collecting, containing, transporting and disposing of pet waste that generally result in the ultimate disposition pet waste in the garbage (land fill) or in the compost, neither of which is environmentally sound nor healthful.

First, the present invention replaces the common use of plastic bags to comply with directives to pick up pet waste, which has resulted in pet owners depositing the pet waste and the plastic bags in the garbage and ultimately in the landfill, where it may remain inert for centuries and longer.

Second, with the banning of plastic bags in many locales, some pet owners have moved to using biodegradable bags to pick up pet waste, and now deposit the waste in either the garbage, or as suggested by the use of a biodegradable bag, in the compost. The pathogens found in pet waste create a health risk when added to compost. The present invention replaces the current practice of pet-owner reliance on an increasingly diminishing supply of environmentally unsound plastic bags or on the improper use of compostable biodegradable bags (intended for food waste disposal) to clean up pet waste.

Third, the present invention encourages pet waste clean-up by alleviating the unpleasant feel, the foul odors, and the lack of sanitation that result when the human hand and other body parts come in contact with pet waste, which is inevitable with the use of easily split plastic bags, and worse, with permeable, even more easily split biodegradable bags, to pick up, transport and dispose of pet waste.

Fourth, the present invention improves on the more cumbersome pet waste clean-up devices currently available on the market that are designed for yard-clean up, but not for both yard clean-up and portability for clean-up after dogs in public spaces. The present invention will benefit not only individual pet owners, kennels, and pet trainers, but also those involved in the increasingly the popular business of dog walking with multiple dogs in public parks and spaces, particularly in the nation's increasingly crowded urban areas.

Fifth, the present invention replaces prior art and current clean-up practices with a unique system of storing the shovel unit and the feces in an airtight container which effectively protects the owner from the foul odor of feces while walking the pet and eliminates fecal contact with the owner's skin, thereby promoting sanitation, peace of mind, and more enjoyable outdoor experience with one's pet or pets.

Sixth, the present invention allows for temporary storage and transportation of pet waste separate from the pet owner's personal belongings, such as back packs, fanny packs, or waste packs, shopping bags, or purses, thus allowing for a more enjoyable experience with one's pet or pets.

Seventh, the present invention addresses the environmental need to reduce exposure to pathogens, pollutants, and gaseous emissions caused by pet waste that is not properly cleaned up and disposed of into waste water treatment facilities.

Eighth, the present invention also decreases contamination of the watershed by promoting appropriate pet waste disposal into waste water treatment facilities for both pets at home (yard clean-up) and pets out walking (public-space clean-up).

BRIEF SUMMARY OF THE INVENTION

The present invention is an ergonomic hand-held apparatus to be used by individuals for the sanitary collection, temporary storage, containment, transport, and environmentally sound disposal of pet waste.

The present invention comprises a portable waste receptacle container with a removable base, a removable lid, and a removable base cap. The bottom of the container is fully open, relying on the removable base to form the bottom of the container when the apparatus is assembled, such that when pet waste is collected into the apparatus, the pet waste can fill the space in both the container and the removable base, and the container can then be closed completely with the lid assembly. The removable lid incorporates a telescopic handle and a shovel unit.

In the preferred embodiment, the container, the removable lid, the telescopic/fixed handle, the shovel unit, the removable base and the removable base cap are made from molded plastics or other polymers, although it will be obvious that metal and other resilient materials, molded or cast could also be used.

The preferred embodiment of the container is an open-bottomed cylindrical unit, though it will be obvious that shapes such as a semi-cylindrical, rectangular, elliptical, other oblong forms, or various shapes could also be made to simultaneously accommodate the shovel unit and the pet waste.

In the preferred embodiment, the container, the removable lid, the removable base, and the removable base lid are sized with the same diameter/perimeter although it will be obvious that these four components could also be of slightly increasing diameter or perimeter.

In the preferred embodiment, the container, the removable lid, the removable base, and the removable base lid are aligned such that the removable lid attaches by compression-plus-quarter-turn threading to the top of the container, the removable base attaches by compression-plus-quarter-turn threading to the bottom of the container, and the removable base cap attaches by compression plus-quarter-turn threading to the bottom (closed end) of the removable base. It will be obvious that other methods of attaching these four "stacked" components such as a compression alone or threading alone, cam lock lever-type buckles, clamps, clips or other fasteners would work provided the apparatus remains easy to assemble and disassemble and remains securely closed when filled with pet waste.

In the preferred embodiment, when assembled the removable base forms approximately the bottom 20 percent of the open-bottomed container, although it will be obvious that the removable base portion could form a larger or smaller percentage of the total size of the container.

Integrally formed with or attached to the top of the removable lid is a telescoping handle. In the preferred embodiment, the top of the handle may incorporate a cap attached by compression or threading which opens to a hollow handle compartment in which to store items such as hand sanitizer, sanitizing towels, mace, a thin flashlight, container liners, etc. In the preferred embodiment, the handle is a telescoping handle integrally formed with or attached to the top of the lid and can be extended and retracted to employ the shovel from a comfortable distance to facilitate the ergonomic and sanitary collection of pet waste. In the preferred embodiment, the handle integrally formed with or attached to the top of the lid may also be a fixed handle.

Integrally formed with or attached to the underside of the removable lid is a shovel unit with a concave scooping blade. In the preferred embodiment, the shovel unit below the removable lid fits inside the container and is aligned to the cylindrical walls of the container to ensure ample room for collected pet waste when the removable lid and the removable base are both attached to the container and closed. It will be obvious that the components of the invention can be made from washable plastic such as polyvinyl chloride, polyethylene, and polypropylene or other polymer-based material or metal.

In the preferred embodiment, the shovel unit is offset and one end is integrally formed with or attached to the underside of the lid such that the blade is offset to one side of the container. The concave blade conforms to the arcuate sidewall of the container and is sufficiently offset to be in close proximity to the side wall of the container. The blade is a trowel-shaped, curved scoop wherein said scooping end is either cut straight across or tapered to a point. It will be readily understood, however, that the blade of the shovel can be made either curved or flat with upwardly turned sides with a straight, tapered or pointed scooping end. It will be readily understood that the offset configuration that results in the concave blade hanging in conformity with and in close proximity to the container wall, configures the interior of the container to make maximum volume available for pet waste. In the preferred embodiment, the length of the shovel unit including the blade is approximately 60 percent of the combined length of the container and the removable base when the apparatus is assembled, though it will be obvious that shorter and longer lengths of the shovel unit may also be manufactured for smaller and larger sizes of the apparatus. It will be obvious that different sizes of the apparatus could be made to accommodate small and large dogs, and single or multiple dogs.

In the preferred embodiment, when the pet owner desires to clean up after his or her pet, he or she grasps the handle of the fully assembled apparatus, removes the lid attached to the container either by compression or threading or a combination of the two, scoops the pet waste into the container with the shovel unit, employing as necessary the telescoping or fixed handle integrally formed with or attached to the top of the lid. The pet owner then replaces the shovel unit in the container, retracts the telescoping handle (if extended), and reattaches the lid to the container either by compression or threading or a combination of the two such that the lid is securely closed. The pet owner then transports the pet waste in the airtight, leak-proof container until he or she is ready to dispose of the pet waste properly. The pet owner then removes the removable base from the container either by compression or threading or a combination of the two and holds both the container and the removable base over the toilet to drop the pet waste in for easy, flushable waste disposal. The apparatus is then easily reassembled using the compression or threaded fittings on the removable base.

The present invention also comprises a removable base cap that is attached to the bottom (closed end) of the removable base. In the preferred embodiment, the removable base cap is attached by compression or threading to the bottom (closed end) of the removable base, though it will be obvious that other possible methods of attachment such as clamps, clips, or other fasteners could also be used. When the base cap is detached from the removable base it may be used as a pet water/food bowl. When attached to the removable base, it creates a "false bottom" storage compartment for small personal items and/or pet items.

The present invention is also designed so as to allow for the use of disposable container liners for the more fastidious pet owner who prefers the convenience of having to rinse out the container less frequently. These liners conform to the shape and size of the interior of the container, covering the interior walls of the container and the interior walls and bottom of the attachable base. These liners will be made of flushable paper such as that used for toilet seat covers, or similarly flushable, biodegradable material. The liners can be scented in various fragrances or unscented.

The present invention also incorporates portability components comprising assemblies attached to the exterior of the container for the purpose of affixing the apparatus to an article of clothing such as a belt, pocket, or waistband to facilitate portability, and to allow the apparatus to be attached to means of personal transportation or equipment for carrying convenience. In the preferred embodiment, a clip component is attached to the side of the container just beneath the lid for the purpose of affixing the invention to an article of clothing. In the preferred embodiment, a second portability component incorporates assemblies also attached to the exterior of the container just beneath the lid, on the opposite side of the container as the first clip component for attachment to personal transportation or equipment. It will be obvious that assemblies could be positioned closer to one another without affecting portability. It will be obvious that other forms of clip, clamp or fastener or strap, band, or tie of rubber, plastic, leather or similar material could be attached to the container to facilitate portability. It will be obvious that a strap or band attached to the container could be made in different lengths, to fit as a belt or a wrist strap.

DETAILED DESCRIPTION OF THE INVENTION

Figure 1:
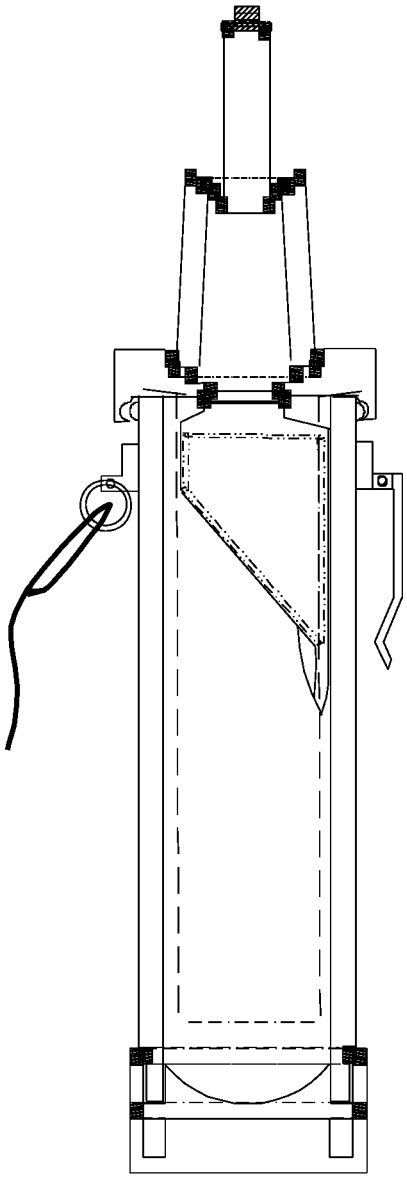
FIG. 1 is a cutaway overview of the invention fully assembled with the telescoping handle above the lid and the offset shovel unit below the lid shown from a side view. The invention is shown in a closed state, with the telescoping handle above the lid retracted, as it is intended to be carried or stored by the user.

While the present invention is susceptible of embodiment in various forms, there is shown in the drawings and will hereinafter be described presently preferred embodiments with the understanding that the present disclosure is to be considered an exemplification of the invented apparatus and is not intended to limit the invention to the specific embodiments illustrated. Referring now to the invention in more detail:

In FIG. 1 there is shown a cutaway overview of the invented apparatus fully assembled. The apparatus is shown in a closed state, with the telescoping handle above the lid retracted, as the apparatus is intended to be carried or stored by the user. Shown in the drawing is a side view of the offset shovel unit below the lid, fitted inside and conforming to the walls of the container thereby allowing for maximum volume of the container to be available for pet waste. In this view, the mount shown on the left side of the container incorporates an open ring (with a tether attached) and a fixed clip on the right side of the unit purpose of attaching the invention to the user's clothing or to other objects commonly used for transportation.

Figure 2:
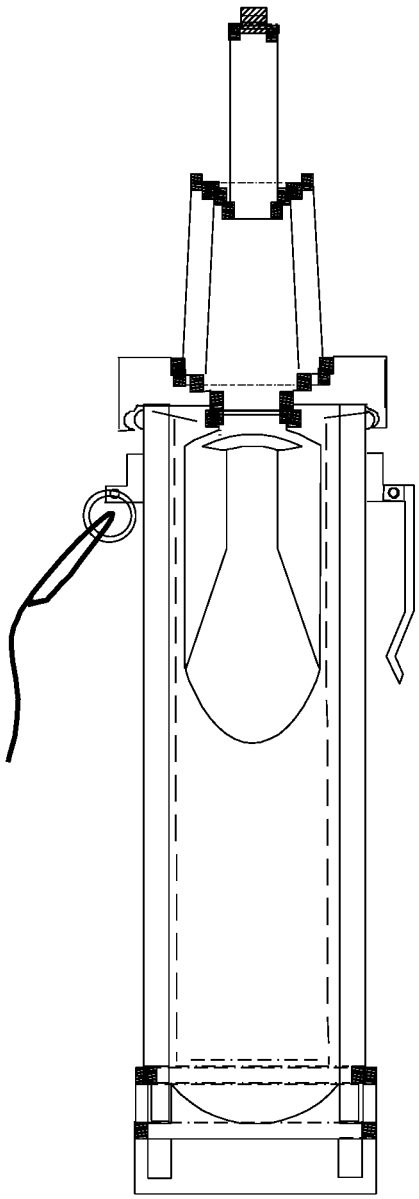
FIG. 2 is a second cutaway overview of the invention fully assembled with the telescoping handle above the lid and the offset shovel unit below the lid shown from a frontal view that is rotated 90 degrees on its vertical axis from the view shown in FIG. 1.

In FIG. 2 the invention is shown in a cutaway view shown from a frontal view that is rotated 90 degrees on its vertical axis from the view shown in FIG. 1, also in a closed state, as it is intended to be carried or stored by the user. Shown in the drawing is a frontal view of the telescoping handle above the lid and the offset shovel unit below the lid and fitted inside the container.

Figure 3:
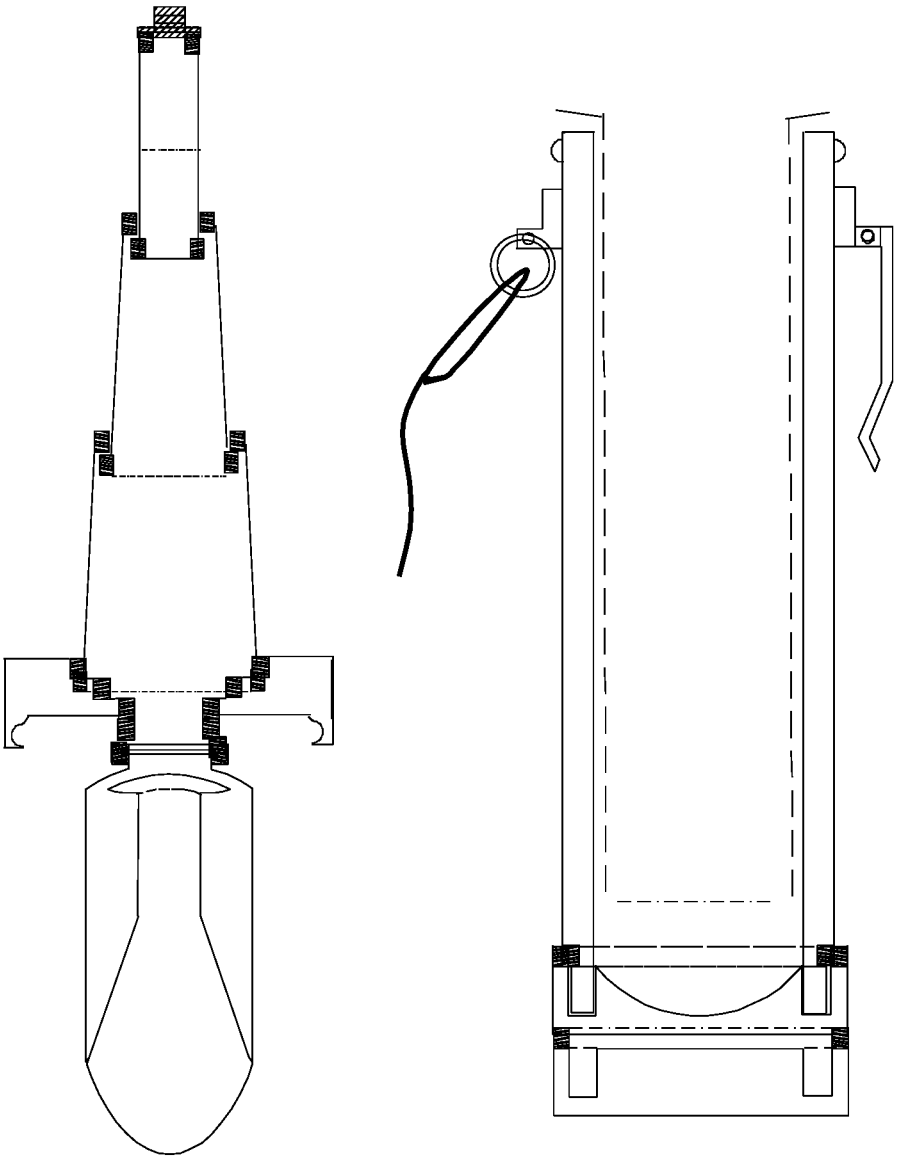
FIG. 3 is a third cutaway overview of the invention partially disassembled with the orientation similar to that shown in FIG. 2. The invention is shown with the telescoping handle extended above the detached lid, as it is intended to be deployed by the user for scooping up pet waste.

In FIG. 3, the invention is shown with telescoping handle/shovel unit detached and extended, as it is intended to be deployed by the user, with its telescopic handle extended for easier reach and for maintaining the user's physical distance when scooping up solid pet waste. Also shown is the removable base for easy disposal of pet waste.

Figure 4:
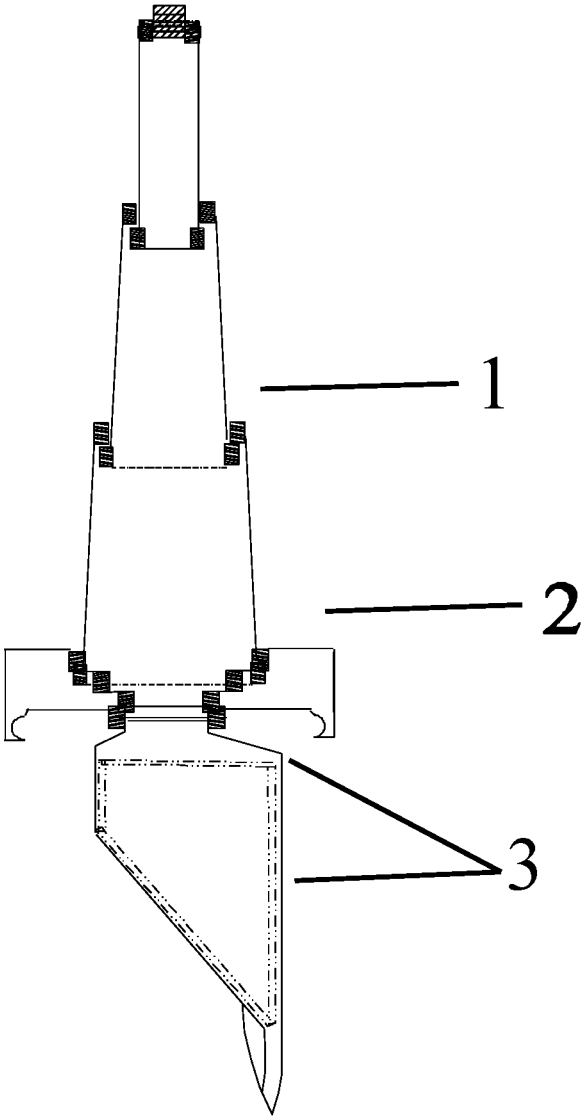
FIG. 4 is a view of the shovel unit and extended telescopic handle with the components identified in greater detail.

In FIG. 4, the invention is shown with the shovel unit offset from the center point of the telescopic handle and lid and aligned with and in proximity to the cylindrical walls of the container to create sufficient volume for pet waste in the empty camber of the container.

Figure 5:
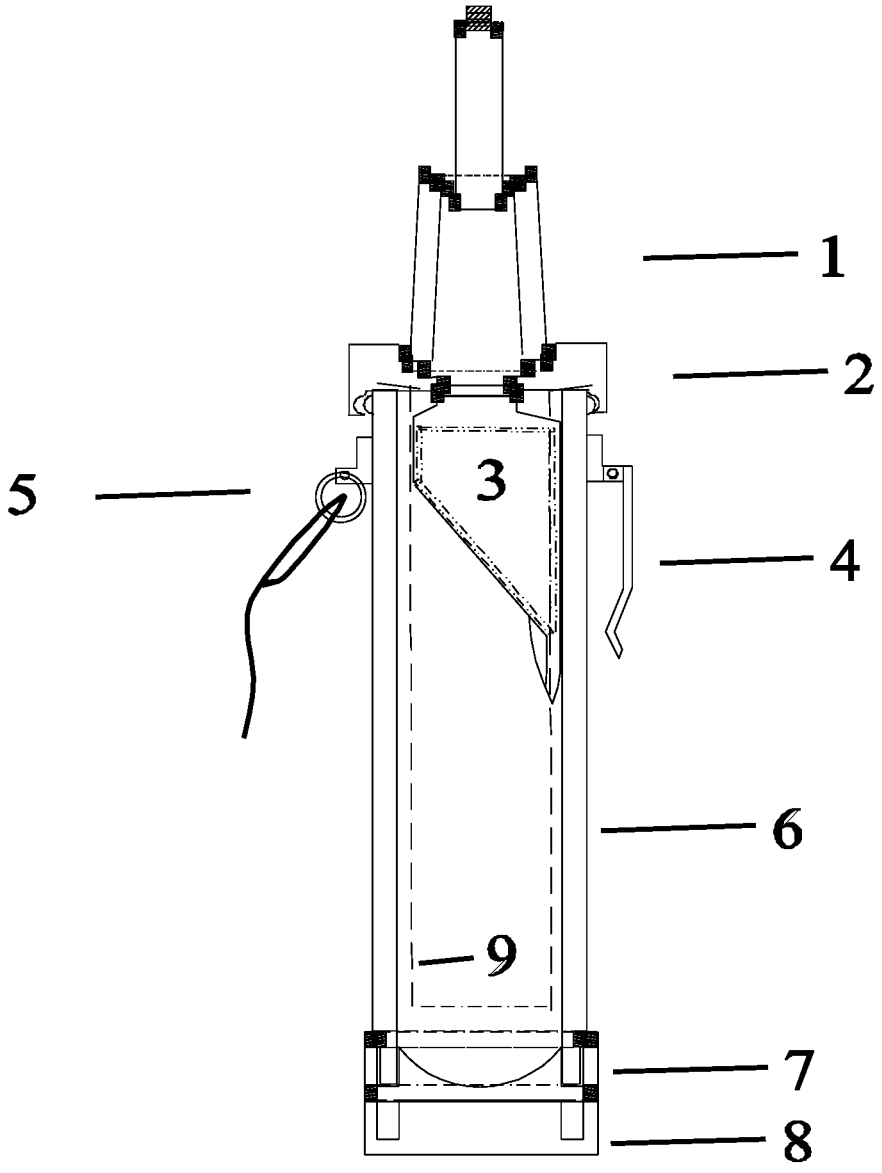
FIG. 5 is a cutaway view of the invention similar to FIG. 1 with the components identified in greater detail.

In FIG. 5 the invention is shown as a cutaway in its closed (portable, storage) state, including a side view of the telescoping handle/shovel unit, the canister, the replaceable base, and the ring and fixed clip assemblies joined to the side of the canister for portability.

Figure 6:
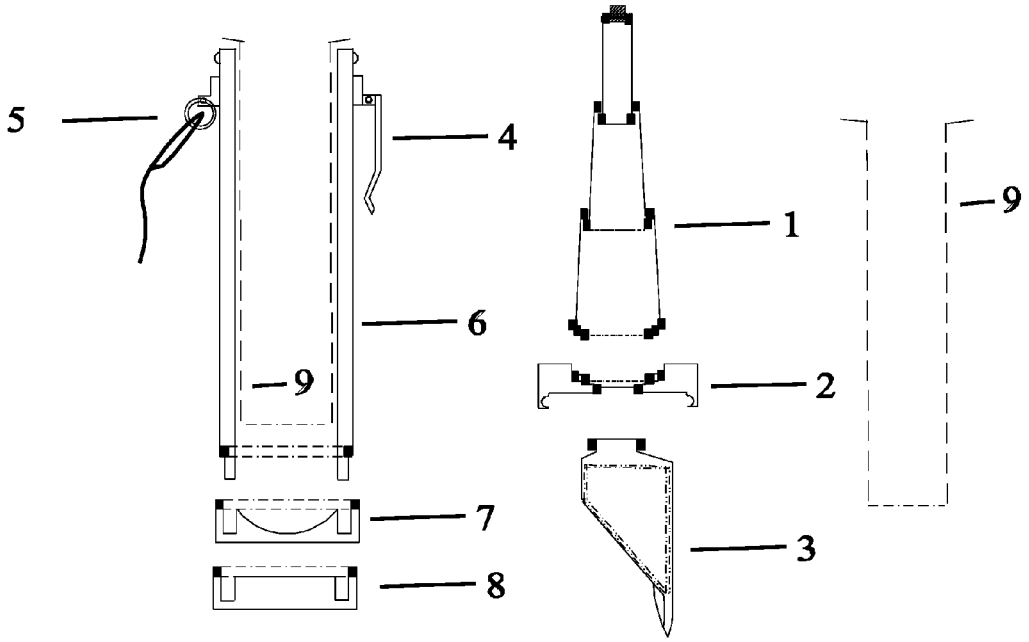
FIG. 6 is a view of the invention's components disassembled with the components identified in greater detail.

In FIG. 6 the invention is shown disassembled with each of its component parts which when assembled form the pet waste collection system of the invention that incorporates improved portability and sanitation, ergonomic collection, and optimal environmental disposal of waste.

While the foregoing written description of the invention enables one of ordinary skill to make and use what is considered presently to be the best mode thereof, those of ordinary skill will understand and appreciate the existence of variations, combinations, and equivalents of the specific embodiment, system, and examples herein. The invention should therefore not be limited by the above described embodiment, system, and examples, but by all embodiments and systems within the scope and spirit of the invention defined by the appended claims.

APPENDIX A

The prior art found in a search of U.S. Patents revealed the following:

Utility U.S. Pat. No. 6,039,368, Mar. 21, 2000, Kowalczyk
Design Patent D 310,436, Sep. 4, 1990, Korth
Utility Patent Eustis
Utility U.S. Pat. No. 3,796,453 A, March, 1974, Grimes; Lillian P.
Utility U.S. Pat. No. 4,226,456 A, October, 1980, Barnett; John C.
Utility U.S. Pat. No. 5,829,603 A, November, 1998, Martineau; Luc
Utility U.S. Pat. No. 5,945,076A, August, 1999, Leonard; Stephen B.
Utility Patent US2014/0183886, Jul. 3, 2014, Hollett, Elaine Lisa

DRAWING REFERENCES

FIG. 1—Invention fully assembled
FIG. 2—Invention fully assembled, rotated 90 degrees
FIG. 3—Invention in an open, extended state
FIG. 4—Integrated handle/shovel unit
- Item 1—Telescopic handle
- Item 2—Removable lid
- Item 3—Offset shovel FIG. 5—Invention in greater detail
- Item 1—Telescopic handle
- Item 2—Removable lid
- Item 3—Offset shovel
- Item 4—Fixed clip portability component Item 5—Portability ring assembly (with tether shown)
Item 6—Cylindrical container
Item 7—Removable container base
Item 8—Removable base compartment/cap
Item 9—Biodegradable/flushable liner FIG. 6—Invention in greater detail
Item 1—Telescopic handle
Item 2—Removable lid
Item 3—Offset shovel
Item 4—Fixed clip portability component
Item 5—Portability ring assembly (with tether shown)
Item 6—Cylindrical container
Item 7—Removable container base
Item 8—Removable base compartment/cap
Item 9—Biodegradable/flushable liner

The invention claimed is:

1. A portable pet waste receptacle apparatus with shovel assembly and removable base cap to address the needs of pet owners to walk their pets and collect and dispose of the pet waste, said apparatus comprising:

a) a cylindrical container including at least one side wall, open at both ends, and with a first and second coupling element at each end;

b) a shovel assembly including an annular lid, a scooping blade, and a telescoping handle, wherein said lid includes a third coupling element, and wherein said scooping blade is sized and aligned to be housed within said cylindrical container and is integrally formed with and depends from an internal planar surface of said lid; and wherein the handle is integrally formed with and protrudes from an external planar surface of said lid;

c) a cylindrical removable base, including at least one side wall, open at one end with a fourth coupling element and a flat bottom at the other end with a fifth coupling element;

d) a cylindrical removable base cap, including at least one side wall, open at one end with a sixth coupling element and a flat bottom at the other end; and wherein the scooping blade of the shovel assembly is configured as a concave scoop and said blade is offset from a center of said lid and depending adjacent to interior walls of said cylindrical container such that said scooping blade is offset sufficiently to one side of said container and conforms to the walls of said container and its length is less than the combined length of said container and said removable base when the apparatus is assembled.

2. The apparatus of claim 1, wherein:

(a) the first coupling element of said container serves to join by means for connecting mechanically with the third coupling element of said annular lid;

(b) the second coupling element of said container serves to join by means for connecting mechanically with the fourth coupling element at the open end of said removable base; and (c) the fifth coupling element of said removable base serves to join by means for connecting mechanically with the sixth coupling element at the open end of said removable base cap.

3. The system of claim 2, wherein the first coupling element of said container serves to join by means for connecting mechanically with the third coupling element of said annular lid at one end of said cylinder, and the second coupling element of said container serves to join by means for connecting mechanically with the fourth coupling element at the open end of said removable base at the other end of the cylinder to create a cylindrical chamber capable of being closed off at the end joined to said removable base and open at the other end with the shovel assembly to collect pet waste, and then securely closed at said both ends to secure both the scooping blade and the collected pet waste while transporting, and to allow for opening and decoupling of said both ends of the cylindrical container for ease of disposal of pet waste and to facilitate cleaning of all parts of the apparatus.

4. The system of claim 3 wherein said cylindrical container when coupled with said removable base and with said annular lid creates a chamber with sufficient volume to accommodate said shovel assembly, a liner, and collected pet waste.

5. The system of claim 2, wherein said cylindrical container is adapted to accept a disposable, flushable, biodegradable liner roughly conforming to the size and shape of said cylindrical container and said removable base.

6. The system of claim 5, such that said liner covers the interior walls of said cylindrical container and interior walls and bottom of said removable base to enhance cleanliness and encourage environmentally proper disposal of pet waste.

7. The system of claim 2, wherein the fifth coupling element of said removable base serves to join by means for connecting mechanically with the sixth coupling element at the open end of said removable base cap to create a hollow chamber capable of being securely separated from pet waste collected in said cylindrical container.

8. The system of claim 7, wherein said removable base joined with said removable base cap creates a closed chamber with sufficient volume to accommodate items of the user's choice to facilitate dog walking.

9. The system of claim 2, wherein an external wall of said cylindrical container incorporates at least one fixed clip or tether to attach said container to a user's article of clothing or mode of personal transportation to facilitate portability and to free up the user's hands for dog care.

* * * * *